US006168326B1

(12) United States Patent
Christian

(10) Patent No.: US 6,168,326 B1
(45) Date of Patent: Jan. 2, 2001

(54) HOLDER FOR EMBOSSING A CARD

(76) Inventor: Beth Christian, 4221 Lilac La., Mountain Green, UT (US) 84050

( * ) Notice: Under 35 U.S.C. 154(b), the term of this patent shall be extended for 0 days.

(21) Appl. No.: 09/099,719

(22) Filed: Jun. 19, 1998

(51) Int. Cl.[7] ..... B41J 1/54
(52) U.S. Cl. ..... 400/127; 400/129
(58) Field of Search ..... 400/127, 129, 400/131, 132, 134; 269/3, 329; 254/131.5

(56) References Cited

U.S. PATENT DOCUMENTS

| | | | | |
|---|---|---|---|---|
| 304,963 | * | 9/1884 | Shepard et al. | 269/3 |
| 2,311,433 | * | 2/1943 | Dershem | 269/3 |
| 2,487,997 | * | 11/1949 | West | 269/3 |
| 4,753,472 | * | 6/1988 | Fout | 294/32 |
| 5,224,745 | * | 7/1993 | Howell | 294/19.1 |
| 5,341,976 | * | 8/1994 | Rider | 224/269 |

* cited by examiner

*Primary Examiner*—John S. Hilten
*Assistant Examiner*—Anthony H. Nguyen
(74) *Attorney, Agent, or Firm*—Thompson E. Fehr

(57) ABSTRACT

A holder for embossing a card which permits manipulation of the card and shields the user's hand from heat employed during the process of embossing. A heat-resistant clip has a first side with a straight tip and a second side with the tip curving away from the straight tip to facilitate the introduction, manipulation, and extraction of a paper card without damaging such card. A spring force retains the card in the clip and permits the clip to adjust to cards of different thicknesses. The base of the clip is attached to a handle which, to protect the hand of the user from heat applied near the clip during the process of embossing, has a low thermal conductivity and is of sufficient length to preclude the user's hand from being in the flow of heat that is applied near the clip. And, to facilitate manipulating the handle with a single hand, the handle has a circular cross section.

12 Claims, 2 Drawing Sheets

HOLDER FOR EMBOSSING A CARD

BACKGROUND OF THE INVENTION

1. Field of the Invention

This invention relates to a holder for a paper card to which ink and embossing powder are applied and subjected to heat in order to create an embossed design on the card.

2. Description of the Related Art

There appears to be no United States patent covering a device for holding a paper card upon which an embossed design is to be created.

In fact, only one United States patent seems even to suggest that the device of such patent can be utilized as a holder for a piece of paper, viz., U.S. Pat. No. 4,953,905, which is entitled "Telescoping Display Device." (The patent, on line 29 through line 32 of column 1, states that such device "can be used to hold a card or note upon which desired information can be placed." It does not declare that such card or note would be composed of paper.) As would be expected from the purpose of that invention, the patent does not provide either that the handle is to have low thermal conductivity or that the clip for holding the card is heat resistant. Therefore, the clip could melt; and the hand of the user could be burned if one attempted to utilize the Telescoping Display Device for embossing.

Somewhat related to the preceding patent is U.S. Pat. No. 5,112,016, which is entitled "Parking Pass-card Handling Device." Again, however, as would be expected from the purpose of that invention, the patent does not provide either that the handle is to have low thermal conductivity or that the means for retaining the card is heat resistant. Therefore, the means for retaining the card could melt; and the hand of the user could be burned if one attempted to utilize the Parking Pass-card Handling Device for embossing.

Several other patents exist for devices which have a handle attached to some means for retaining an object.

U.S. Pat. No. 5,224,745 has a handle connected to a clamping system which, in the claims, is clarified to be a device for releasably holding a flat plastic clip that is intended to hold items on a tree limb. However, not only is the handle not state to have low thermal conductivity, but the clamping system is not stated to be of such construction that it would not damage a paper card.

A portion of the System for Installing Automobile Baby Seats, which is the subject of U.S. Pat. No. 5,496,083, involves, according to line 10 through 13 of column 2, an "elongated member 12, preferably of an appropriate molded plastic composition, [which] includes a central extender 16 that is bounded at opposed ends by a handle 18 and a clip member 20." Thus, although the handle is not stated to have low thermal conductivity, it is preferably composed of plastic, which would have low thermal conductivity. The clip member 20 is, however, also preferably plastic and is understandably not declared to be heat resistant. The clip member 20 would, therefore, melt if exposed to the heat necessary to emboss a card. Furthermore, a handle 18, being perpendicular to the central extender 16 as shown in the figures of the patent, would impeded using the elongated member 12 to hold and manipulate a card during the process of embossing.

And the Bed Sheet Stuffing Device of U.S. Pat. No. 4,890,345 similarly has an awkward shape for holding and manupulating a card during the process of embossing. According to line 56 through line 60 of column 2, "[t]he stuffing device 10 basically includes an elongated, cross-sectionally thin and relatively narrow, flat shaft member 12 and a short clamp element 14 having substantially the same cross-sectional thickness and width as the shaft element 12. Moreover, line 7 through line 9 of column 3 indicate that "the shaft member 12 is composed of resiliently flexible material, for instance, metal such as spring steel or a memory plastic." And line 23 through line 25 of column 3 declare that "[t]he clamp element 14 is preferably composed of the same resiliently flexible material as the shaft member 12." Therefore, not only does this patent not state that the shaft member is not to be thermally conductive; but the shaft member may be composed of thermally highly conductive steel which would bum the hand of one using such a tool for embossing. And not only does the patent not provided that the clamp is to be heat resistant; but the clamp may be constructed from plastic, which would melt during the process of embossing.

SUMMARY OF THE INVENTION

The Holder for Embossing a Card has a handle which has a generally circular cross section to facilitate manipulating the card during the process of embossing.

Furthermore, the length of the handle and, primarily, the fact that the handle is constructed from material having a low thermal conductivity isolate the hand of the user from the heat employed during embossing.

And the clip is constructed of heat resistant material so that it will not be deformed during the process of embossing. Furthermore, the clip is constructed so that it will automatically adjust to cards of different thicknesses and will not puncture or otherwise damage a paper card during insertion of the card, manipulation of the card, or extraction of the card.

DESCRIPTION OF THE PREFERRED EMBODIMENT

Figure 1:
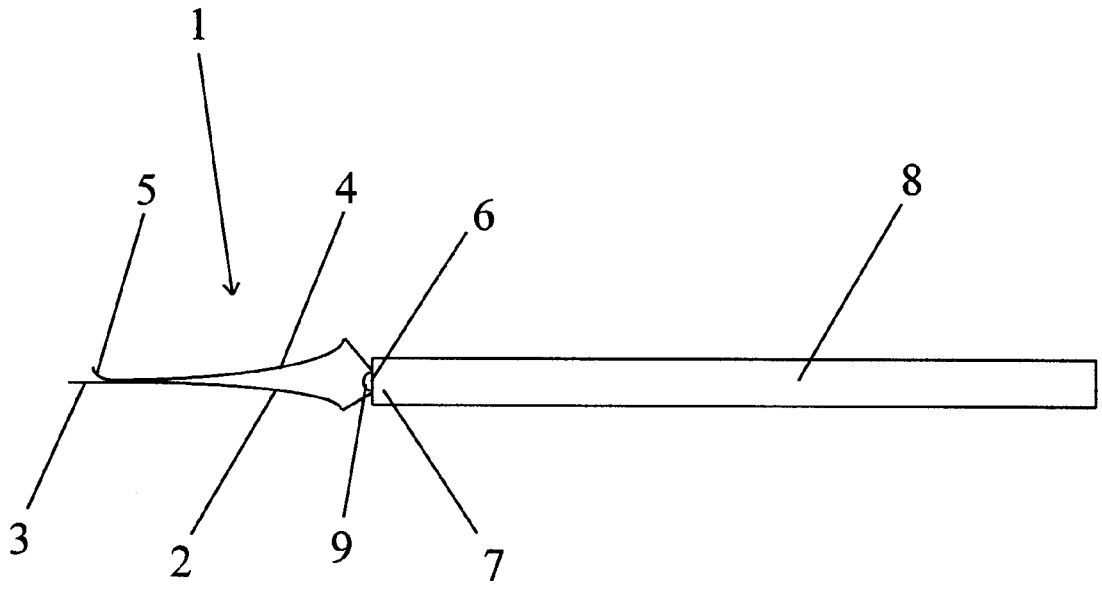
FIG. 1 is a lateral view of the Holder for Embossing a Card.
Figure 2:
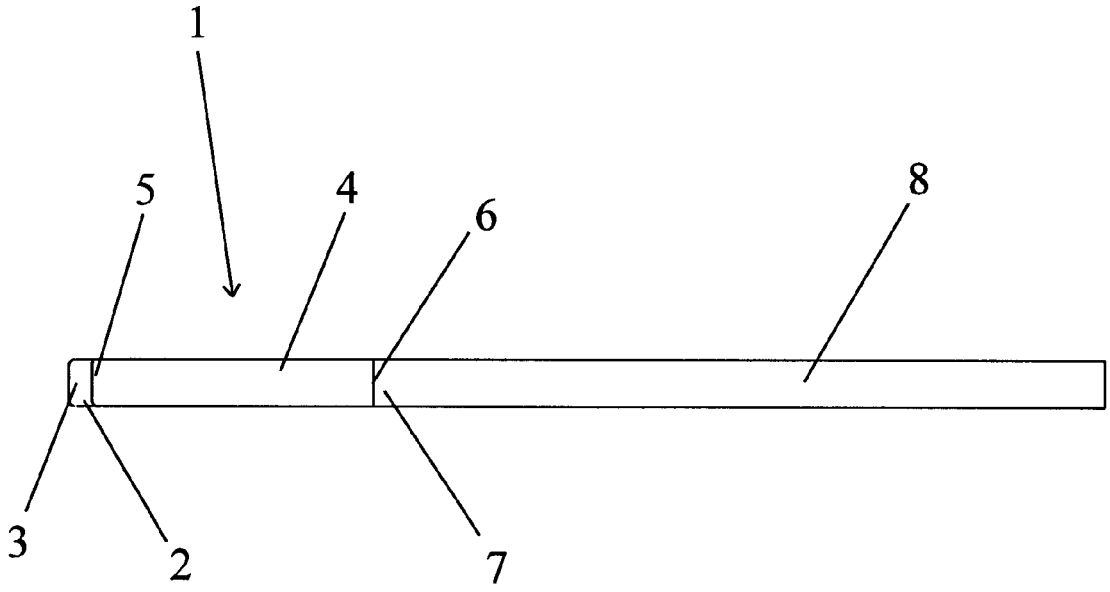
FIG. 2 is a plan view of the Holder for Embossing a Card.

As suggested above, one technique for embossing involves applying ink and embossing powder to a surface of a card. A heat gun is then used to heat and thereby to melt the powder on the card. The powder sets as it subsequently cools and becomes an embossed design.

The present invention comprises a clip 1 having a first side 2 with a straight tip 3 and a second side 4 with a curved tip 5 so that positions on the curved tip 5 near the end of the curved tip 5 which is opposite the base of the clip that are farther from the base 6 of the clip 1 are also farther from the straight tip 3. An edge of a card can, consequently, be placed upon the straight tip 3 and slid under the curved tip 5, thereby assuring that the clip 1 doesn't dig into or otherwise mar a paper card during insertion, retention, or extraction of the card from the clip.

When the first side 2 and the second side 4 of the clip 1 are moved apart, a force-generally termed a "spring" force—urges the first side 2 toward the second side 4, which causes the clip 1 to adjust to cards of different thicknesses and frictionally releasably to retain such cards.

And the clip 1 is heat resistant, preferably being made of metal.

The clip 1 is attached at the base 6 of the clip 1 to a first end 7 of a handle 8 that is made from material that does not conduct heat well, preferably wood. The handle, therefore, impedes the conduction of heat from the card to the hand of the person who is using the Holder to facilitate embossing a card. And, preferably, the handle 8 is of sufficient length further to assist in shielding a user's hand from the heat that is employed in embossing by precluding the user's hand from being in the flow of heat that is applied near the clip during the process of embossing.

Additionally, the handle 8 preferably has a generally circular cross section to facilitate manipulating the handle 8 when, as is customary, a user holds the handle 8 with a single hand.

The clip 1 is preferably attached to the rod 8 with a screw 9.

I claim:

1. A holder for embossing a card, which comprises:

a heat-resistant clip having a base and also having a first side with a straight tip and a second side with a curved tip so that positions on the curved tip near the end of said curved tip which is opposite the base of said clip that are farther from said base of said clip are also farther from said straight tip, wherein moving the first side and the second side apart creates a spring force urging the first side toward the second side for gripping the card during, before or after the embossing; and a handle composed of material having a low thermal conductivity that is attached to the base of the clip.

2. The holder for embossing a card as recited in claim 1, wherein:

the heat-resistant clip is composed of metal.

3. The holder for embossing a card as recited in claim 2, wherein:

the handle is composed of wood.

4. The holder for embossing a card as recited in claim 3, wherein:

the handle has a generally circular cross section.

5. The holder for embossing a card as recited in claim 4, wherein:

the handle is of such length as to preclude a user's hand from being in the flow of heat that is applied near the clip during the process of embossing.

6. The holder for embossing a card as recited in claim 5, wherein:

the handle is attached to the base of the clip with a screw.

7. The holder for embossing a card as recited in claim 2, wherein:

the handle is attached to the base of the clip with a screw.

8. The holder for embossing a card as recited in claim 1, wherein:

the handle is composed of wood.

9. The holder for embossing a card as recited in claim 8, wherein:

the handle has a generally circular cross section.

10. The holder for embossing a card as recited in claim 9, wherein:

the handle is of such length as to preclude a user's hand from being in the flow of heat that is applied near the clip during the process of embossing.

11. The holder for embossing a card as recited in claim 10, wherein:

the handle is attached to the base of the clip with a screw.

12. The holder for embossing a card as recited in claim 1, wherein:

the handle is attached to the base of the clip with a screw.

* * * * *